US007287536B2

(12) United States Patent
Steck et al.

(10) Patent No.: US 7,287,536 B2
(45) Date of Patent: Oct. 30, 2007

(54) HEATER FOR HEATING THE DISHWASHING LIQUID IN A DISHWASHER

(75) Inventors: Wolfgang Steck, Giengen (DE); Helmut Jerg, Giengen (DE); Ernst Stickel, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 128 days.

(21) Appl. No.: 09/883,809

(22) Filed: Jun. 18, 2001

(65) Prior Publication Data

US 2001/0042560 A1 Nov. 22, 2001

Related U.S. Application Data

(63) Continuation of application No. PCT/EP99/09610, filed on Dec. 7, 1999.

(30) Foreign Application Priority Data

Dec. 16, 1998 (DE) ..... 198 58 137

(51) Int. Cl.
*B08B 3/02* (2006.01)

(52) U.S. Cl. ..... 134/107; 134/108; 134/186

(58) Field of Classification Search ..... 134/105, 134/107, 108, 186
See application file for complete search history.

(56) References Cited

U.S. PATENT DOCUMENTS 1,816,662 A * 7/1931 Sobolik
1,871,688 A * 8/1932 Heller
2,066,127 A * 12/1936 Slayter ..... 392/343
2,748,762 A * 6/1956 Booth ..... 159/1.1
2,962,604 A * 11/1960 Walker
2,963,979 A * 12/1960 Eisenmann et al. ..... 210/416.1
3,051,182 A 8/1962 Gibson
3,051,184 A * 8/1962 Gibson ..... 134/183
3,072,129 A * 1/1963 Seal
3,238,998 A * 3/1966 Moore et al.
3,256,828 A * 6/1966 Rule ..... 417/363
3,348,487 A * 10/1967 Miller ..... 417/50
3,530,864 A * 9/1970 Wright ..... 134/58 D
3,576,378 A 4/1971 Hilmanowski
3,587,939 A 6/1971 Nystuen et al.

(Continued)

FOREIGN PATENT DOCUMENTS

DE 6601550 3/1969

(Continued)

OTHER PUBLICATIONS

European Patent Office 0 784 151 Jul. 1997.*

*Primary Examiner*—Frankie L. Stinson
(74) *Attorney, Agent, or Firm*—Russell W. Warnock; Craig J. Loest; James E. Howard

(57) ABSTRACT

In a dishwasher having a dishwashing compartment and a pump fluidically connected to the dishwashing compartment for channeling liquid to the dishwashing compartment, the pump disposed outside the dishwashing compartment and including a pump housing defining an interior and housing a motor and an impeller, a heater for heating dishwashing liquid includes a heating device disposed on the pump housing in heat-conducting contact with the interior of the pump housing.

19 Claims, 5 Drawing Sheets

U.S. PATENT DOCUMENTS

| | | | | | |
|---|---|---|---|---|---|
| 3,587,989 | A | | 6/1971 | Fisher et al. | |
| 3,750,951 | A | | 8/1973 | Perl | |
| 4,195,667 | A | * | 4/1980 | Moore et al. | 137/637.1 |
| 4,349,434 | A | * | 9/1982 | Jaworski | 210/94 |
| 4,429,845 | A | * | 2/1984 | Stover et al. | 246/428 |
| 4,594,500 | A | * | 6/1986 | Wright | 392/471 |
| 4,600,821 | A | * | 7/1986 | Fichtner et al. | |
| 4,629,844 | A | * | 12/1986 | Griffith et al. | |
| 5,333,991 | A | * | 8/1994 | Kato | |
| 5,350,275 | A | * | 9/1994 | Ishimaru | |
| 5,521,358 | A | * | 5/1996 | Eilentropp | 219/549 |
| 5,585,025 | A | * | 12/1996 | Idland | 219/497 |
| 5,642,987 | A | * | 7/1997 | Taricco | 417/53 |
| 5,692,885 | A | * | 12/1997 | Langer | 417/420 |
| 5,868,937 | A | * | 2/1999 | Back et al. | 210/651 |
| 5,914,065 | A | * | 6/1999 | Alavi | |
| 6,126,425 | A | * | 10/2000 | Fukui | 418/83 |
| 6,200,108 | B1 | * | 3/2001 | Caudill et al. | 417/366 |
| 6,250,875 | B1 | * | 6/2001 | Bauer et al. | 415/10 |

FOREIGN PATENT DOCUMENTS

| | | | | |
|---|---|---|---|---|
| DE | 36 27 1 807 392 | | * | 6/1970 |
| DE | 2 328 655 | | | 6/1974 |
| DE | 2938883 | | * | 9/1981 |
| DE | 34 08 218 | | * | 9/1985 |
| DE | 35 28 696 | C1 | | 9/1986 |
| DE | 35 30 531 | | * | 3/1987 |
| DE | 36 26 955 | A1 | | 2/1988 |
| DE | 36 27 732 | | * | 2/1988 |
| DE | 36 35 375 | | * | 4/1988 |
| DE | 36 35 475 | | * | 4/1988 |
| DE | 36 40 252 | | * | 6/1988 |
| DE | 19821148 | | * | 11/1999 |
| FR | 2496777 | | * | 12/1980 |
| FR | 2 496 777 | | * | 6/1982 |
| FR | 2 567 156 | | * | 1/1986 |
| GB | 1422371 | | * | 1/1976 |
| GB | 2119609 | | * | 11/1983 |
| GB | 2 193 563 | A | | 2/1988 |
| GB | 2212901 | | * | 8/1989 |
| JP | 55-56561 | | * | 4/1980 |
| JP | 58-72699 | | * | 4/1983 |
| JP | 1-237393 | | * | 9/1989 |
| JP | 5-164093 | | * | 6/1993 |
| JP | 6-90873 | | * | 4/1994 |
| JP | 7-12086 | | * | 1/1995 |
| JP | 9-148047 | | * | 6/1997 |
| JP | 10-22060 | | * | 1/1998 |
| JP | 10-103297 | | * | 4/1998 |
| SU | 521885 | | * | 10/1976 |
| WO | WO96/19672 | | * | 6/1996 |

* cited by examiner

HEATER FOR HEATING THE DISHWASHING LIQUID IN A DISHWASHER

CROSS-REFERENCE TO RELATED APPLICATION

This application is a continuation of copending International Application No. PCT/EP99/09610, filed Dec. 7, 1999, which designated the United States.

BACKGROUND OF THE INVENTION

Field of the Invention

The invention lies in the field of appliances. The invention relates to a heater for heating the dishwashing liquid in a dishwasher with a pump that is connected for liquid-channeling action to a dishwashing compartment, is disposed outside the dishwashing compartment and, essentially, includes a motor and an impeller disposed in a pump housing.

Dishwashers are operated by dishwashing programs in which a pump circulates heated dishwashing liquid. The dishwashing liquid acts by corresponding devices, usually by spray devices such as rotating spray arms, on items that are disposed in a treatment space—a dishwashing compartment—and are to be cleaned.

To heat the dishwashing liquid, heaters are disposed in dishwashers, these heaters, as is the case, for example, in German Published, Non-Prosecuted Patent Application DE 35 28 696 A1, being disposed on the base of the dishwashing compartment. Configuring heaters on the base of the dishwashing compartment results in a reduction in the space into which items that are to be cleaned can be introduced and increases the formation of limescale on the heaters due to the evaporation of the dishwashing liquid as the heaters are repeatedly dried to the full extent. To avoid the disadvantages, the heaters, as is described, for example, in German Published, Non-Prosecuted Patent Application DE 36 26 955 A1, are also disposed in a flow heater that may be disposed outside the dishwashing compartment. Such a configuration requires additional outlay in terms of liquid-channeling lines and reduces the space in which subassemblies required in a dishwasher can be disposed. U.S. Pat. No. 3,576,378 to Hilmanowski describes allowing the motor of the pump to project into the dishwashing container, for the purpose of saving energy, to utilize the operational heat of the motor in addition to the heaters for the purpose of heating the dishwashing liquid. Also described, for example, in German Published, Non-Prosecuted Patent Application DE 29 38 883 A1, is a configuration where the heaters are disposed around the motor of the pump. The motor projects into the dishwashing compartment, to ensure sufficient heating of the dishwashing liquid. In the configuration, the number of line through-passages through the dishwashing compartment that require sealing is to be kept as small as possible. It has been found in practice that such a configuration may result in heating that adversely affects the motor. Moreover, of course, the disadvantageous formation of limescale on the heaters that has already been outlined above appears again. In addition, very high-outlay seals for electric cables that are to be led out of the motor into the dishwashing compartment are necessary.

SUMMARY OF THE INVENTION

It is accordingly an object of the invention to provide a heater for heating the dishwashing liquid in a dishwasher that overcomes the hereinafore-mentioned disadvantages of the heretofore-known devices of this general type and that provides an efficient heater, for heating the dishwashing liquid, that is disposed outside the dishwashing compartment without restricting the space for further subassemblies of the dishwasher and on the pump housing in heat-conducting contact with the interior of the pump housing.

With the foregoing and other objects in view, in a dishwasher having a dishwashing compartment and a pump fluidically connected to the dishwashing compartment for channeling liquid to the dishwashing compartment, the pump disposed outside the dishwashing compartment and including a pump housing defining an interior and housing a motor and an impeller, there is provided, in accordance with the invention, a heater for heating dishwashing liquid having a heating device disposed on the pump housing in heat-conducting contact with the interior of the pump housing.

Due to the fact that the pump with motor and pump housing, as is predominantly customary at present, is disposed outside the dishwashing compartment, the loading space of the dishwashing compartment is not restricted because liquid-channeling lines that are already required are used. However, according to the invention, because the heating device and/or means are disposed on the pump housing of the pump that is already required, there is no need for any other subassembly in the space outside the dishwashing compartment. The configuration has the result that the space is not restricted in any way as far as other subassemblies are concerned. Because all the dishwashing liquid is circulated by the pump, i.e., is channeled repeatedly through the pump housing, sufficient heating of the dishwashing liquid is reliably ensured and an efficient heater is provided. The invention provides an efficient heater for heating the dishwashing liquid that is disposed outside the dishwashing compartment and that does not restrict the space for further subassemblies of the dishwasher.

To ensure better accessibility to the heater, e.g., for repair work, but also to ensure more straightforward installation and to avoid a reduction in the pump efficiency by disruption to the flow paths of the dishwashing liquid delivered by the pump, the heater, according to a preferred embodiment of the invention, is disposed on the outside of the pump housing.

In accordance with another feature of the invention, the heater is disposed on the outside of the pump housing on that side that is directed toward the motor. By virtue of such placement of the heater in the interspace between the motor and pump housing, there is no need for any additional protection of the heater.

In accordance with a further feature of the invention, the accessibility to the heater, e.g. for repair work, is further improved, but also installation is made more straightforward, in that the heater is disposed on the outside of the pump housing on that side that is directed away from the motor.

In accordance with an added feature of the invention, the heater is advantageously configured as an electrical resistance heater. Preferably, the heater is preferably configured as tubular heaters or alternatively as thick-film heaters.

Good heat transmission to the dishwashing liquid and durability are achieved, in accordance with an additional feature of the invention, in that, in the case of all the above-mentioned alternatives, that part of the pump housing that bears the heating means is produced from stainless high-grade steel.

In accordance with yet another feature of the invention, that part of the pump housing bearing the heater is provided with an enameled surface. In particular, thick-film heaters are used, which are usually applied as a pasty mass directly to the surface and, thus, require an insulating layer with respect to metallic carriers, the use, for example, of enameled metal sheets avoids the application of an additional insulating layer. Furthermore, it is also possible to use non-stainless materials for that part of the pump housing that bears the heater because the enameled surface ensures protection of the surface that comes into contact with the dishwashing liquid, which may possibly be provided with chemical additives.

In accordance with yet a further feature of the invention, there is provided a temperature switch. Alternatively, the temperature switch is a pressure switch or, preferably, a thermostatic switch. Such a temperature switch serves, on one hand, for safeguarding the temperature of the heater and, on the other hand, for regulating the temperature of the dishwashing liquid and/or for controlling the operation of the heater.

In accordance with yet an added feature of the invention, the thermostatic switch is expediently disposed on the pump housing.

To ensure that the heat is not radiated into the surroundings and/or to the motor of the pump, in accordance with yet an additional feature of the invention, the heater is covered by an insulating layer, thus avoiding energy losses and damage to the motor.

In particular, when heaters are disposed on the outside of the pump housing on that side that is directed away from the motor, the insulating layer is expediently covered by a protective plate.

With the objects of the invention in view, there is also provided a dishwasher, including a housing defining a dishwashing compartment, a pump for channeling liquid to the dishwashing compartment, the pump fluidically connected to the dishwashing compartment, disposed outside the dishwashing compartment and inside the housing, and having a motor, an impeller, and a pump housing defining an interior and housing the motor and the impeller, and a heating device for heating dishwashing liquid, the heating device disposed on the pump housing in heat-conducting contact with the interior of the pump housing.

Other features that are considered as characteristic for the invention are set forth in the appended claims.

Although the invention is illustrated and described herein as embodied in a heater for heating the dishwashing liquid in a dishwasher, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
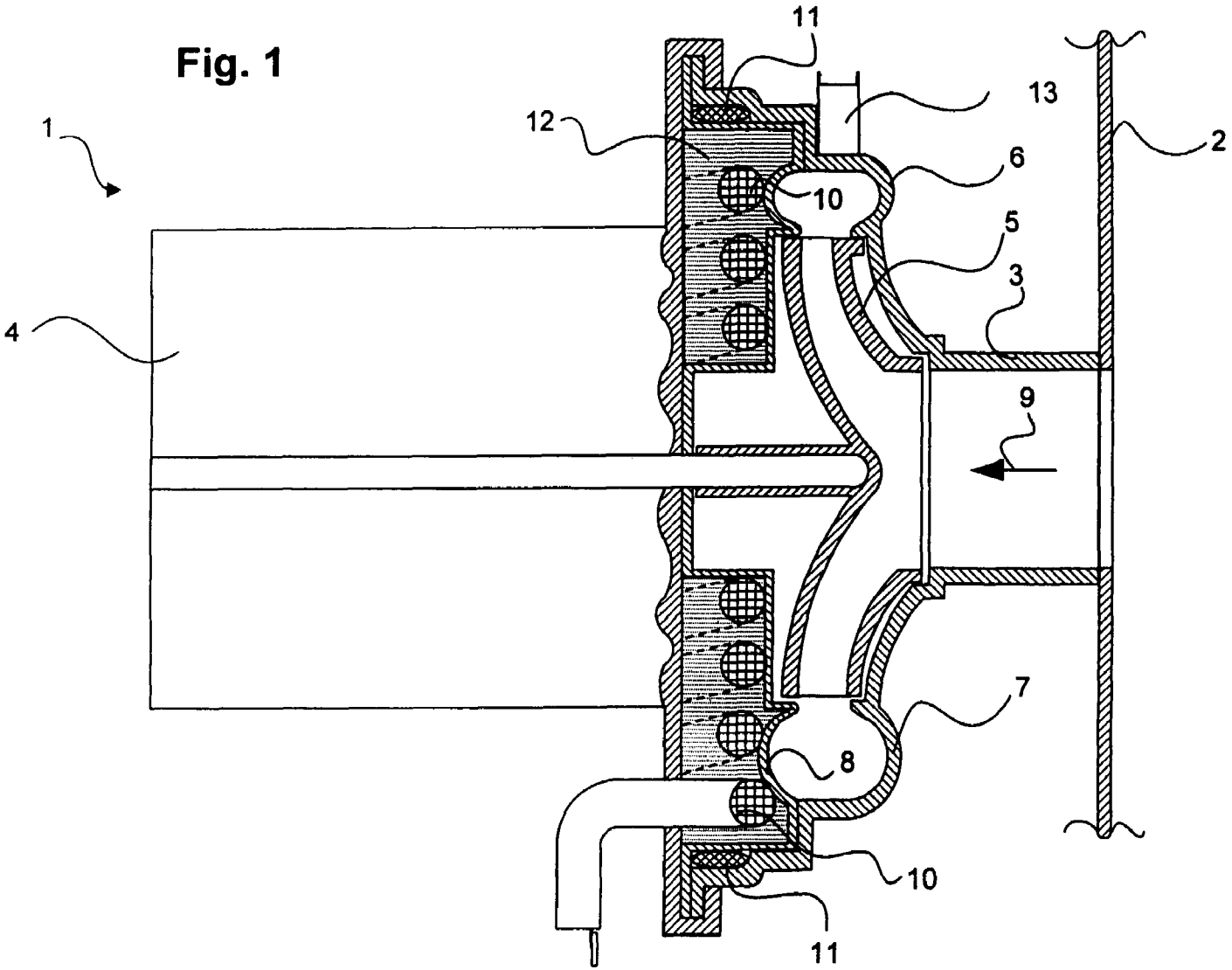
FIG. 1 is a cross-sectional view through a pump of a dishwasher with heaters disposed on the outside of the pump housing on a side directed toward the motor, according to a preferred embodiment of the heater according to the invention.

In all the figures of the drawing, sub-features and integral parts that correspond to one another bear the same reference symbol in each case.

Referring now to the figures of the drawings in detail and first, particularly to FIG. 1 thereof, there is shown a pump 1. Dishwashers are operated by dishwashing programs in which heated dishwashing liquid is circulated by a pump 1. The dishwashing liquid acts by corresponding devices, usually by spray devices (not explained in any more detail) such as rotating spray arms, on non-illustrated items that are disposed in a treatment space—a dishwashing compartment 2— and are to be cleaned.

In the case of the dishwashers that are shown in the exemplary embodiments, and are not described in any more detail, the pump 1 is disposed outside the dishwashing compartment 2, which is only partially illustrated. The pump 1 is connected for liquid-channeling action to the dishwashing compartment 2 through an intake connection 3 in a manner that is not described in any more detail. All the exemplary embodiments shown also have in common the fact that the pump 1 essentially includes a motor 4 and an impeller 5. The impeller 5 is enclosed by a pump housing 6 made up of two parts—a pump-housing cover 7 and a pump-housing base 8. The pump-housing cover 7 and the pump-housing base 8 are connected to one another in a bayonet closure, which is not described in any more detail, with the interposition of a seal 11, and to the housing of the motor 4. The motor housing is not explained in any more detail. The flow direction of the dishwashing liquid is indicated by an arrow 9.

According to the invention, heating means or heaters 10, 10' are disposed on the pump housing 6 in heat-conducting contact with the interior of the pump housing 6, i.e., with the dishwashing liquid channeled through the interior of the pump housing 6. All the exemplary embodiments shown also have in common the fact that the heaters 10, 10' are disposed on the outside of the pump housing 6, and that all the heaters 10, 10' shown are configured as an electrical resistance heater. Tubular heaters are designated 10 and thick-film heaters are designated 10'. The heaters 10, 10' are covered by an insulating layer 12, which is indicated by dotted lines in the figures. To safeguard the temperature of the heaters 10, 10' and to regulate the temperature of the dishwashing liquid and/or to control the operation of the heaters 10, 10', a temperature switch 13, in the exemplary embodiments, a thermostatic switch, is disposed on the pump housing 6. Alternatively, it is also possible to use a pressure switch.

Figure 2:
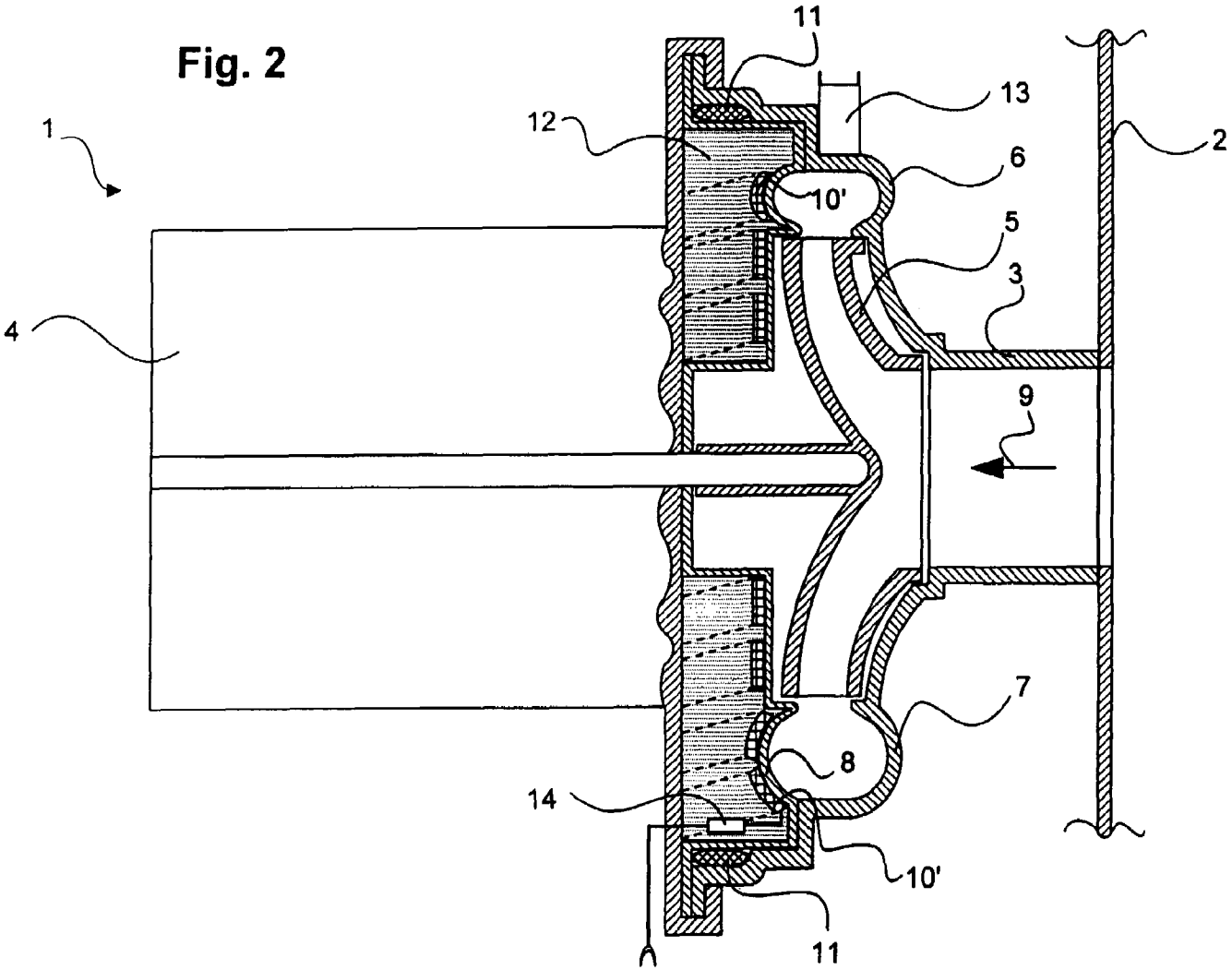
FIG. 2 is a cross-sectional view through an alternative embodiment of the pump of FIG. 1.

FIGS. 1 and 2 show embodiments of the invention in which the heaters 10, 10' are disposed on the outside of the pump housing 6 on a side that is directed toward the motor 4—on the pump-housing base 8. In the exemplary embodiments shown, the pump-housing base 8 bearing the heaters 10, 10' is produced from stainless high-grade steel. Alternatively, that part of the pump housing bearing the heaters may be provided with an enameled surface, which, in particular if use is made of thick-film heaters, makes it possible to dispense with an additional insulating layer. Also, if use is made of tubular heaters, it is additionally possible to use non-stainless materials for that part of the pump housing that bears the heaters.

FIG. 1 shows a preferred embodiment of the invention in which the heaters 10 are tubular heaters 10 soldered helically on the pump-housing base 8.

FIG. 2 shows an advantageous embodiment of the invention in which the heaters 10' are thick-film heaters 10' applied helically to the pump-housing base 8. A fuse 14 may be disposed upstream of the thick-film heater 10' as shown.

Figure 3:
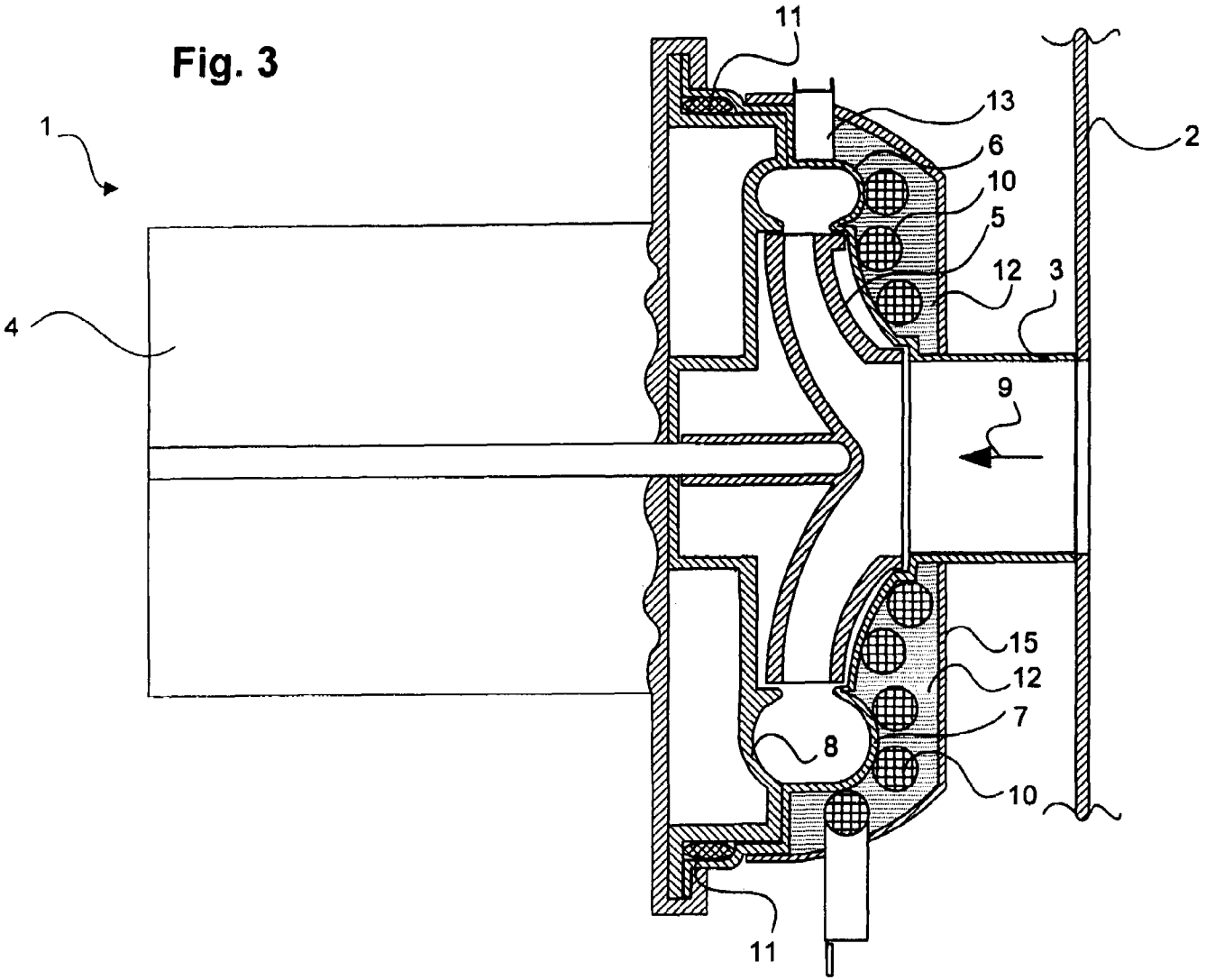
FIG. 3 is a cross-sectional view through a pump of the dishwasher with heaters disposed on an outside of the pump housing on a side directed away from the motor, according to a further advantageous embodiment of the heater according to the invention.
Figure 4:
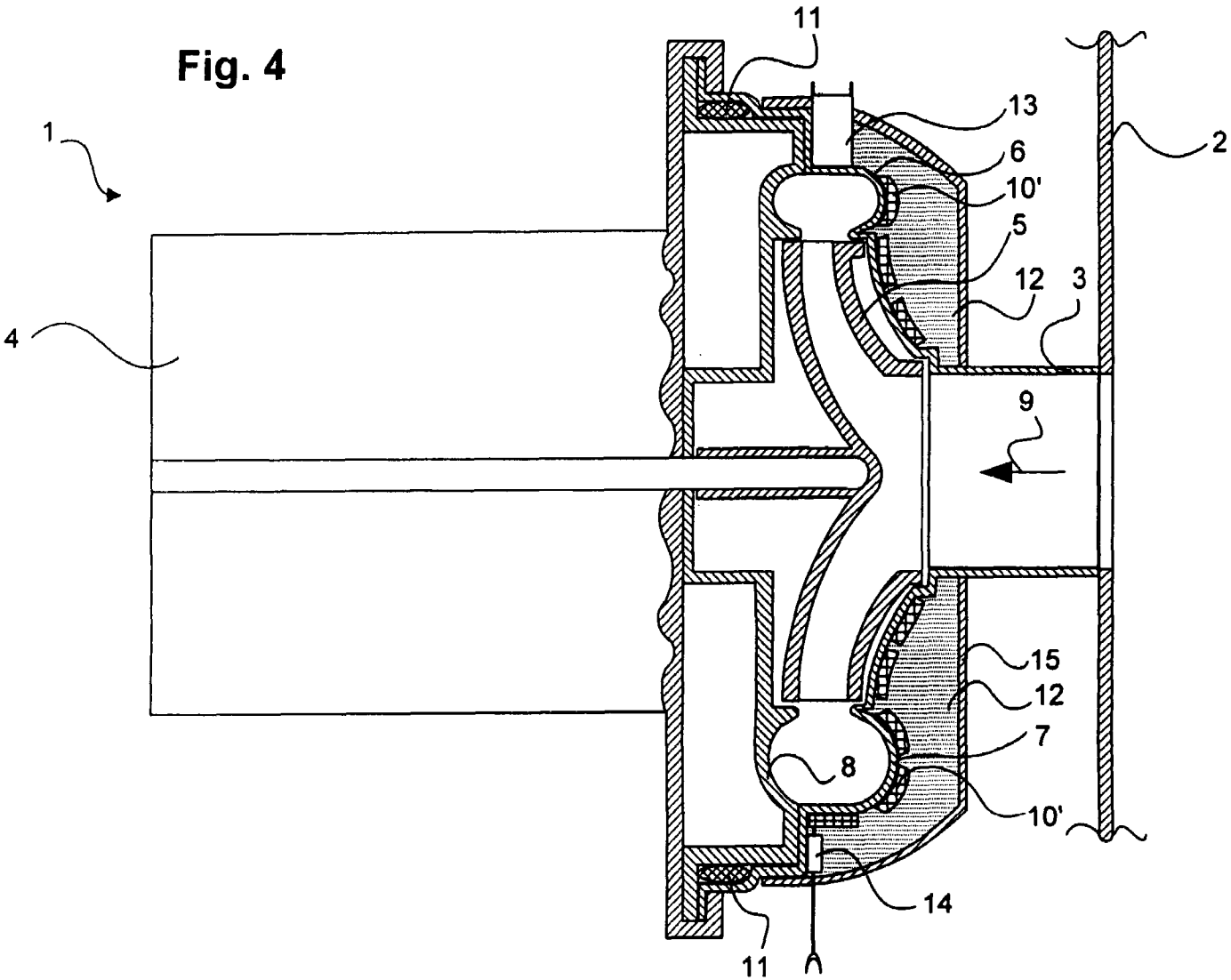
FIG. 4 is a cross-sectional view through an alternative embodiment of the pump of FIG. 4.

FIGS. 3 and 4 show embodiments of the invention in which the heaters 10, 10' are disposed on the outside of the pump housing 6 on a side that is directed away from the motor 4—on the pump-housing cover 7. The pump-housing cover 7 bearing the heaters 10, 10' is produced from stainless high-grade steel. Alternatively, the part of the pump housing bearing the heaters may be provided with an enameled surface, which, in particular, if use is made of thick-film heaters, makes it possible to dispense with an additional insulating layer. Also, if use is made of tubular heaters, it is additionally possible to use non-stainless materials for that part of the pump housing bearing the heaters. A protective plate 15 covers the insulating layer 12.

FIG. 3 shows an advantageous embodiment of the invention, in which the heaters are tubular heaters 10 soldered helically on the pump-housing cover 7.

FIG. 4 shows another advantageous embodiment of the invention, in which the heaters 10' are as thick-film heaters 10' applied helically to the pump-housing cover 7. A fuse 14 may be disposed upstream of the thick-film heater 10' as shown.

Because the pump 1 with motor 4 and pump housing 6, as is predominantly customary at present, is disposed outside the dishwashing compartment 2, the loading space of the dishwashing compartment 2 is not restricted because use is made of the liquid-channeling lines that are already required to supply the pump 1. However, because the heaters 10, 10' are disposed on the pump housing 6 of the pump 1 that is already required, there is no need for any other subassembly in the space outside the dishwashing compartment 2. The configuration has the result that the space is not restricted in any way as far as other subassemblies are concerned. Because all the dishwashing liquid is circulated by the pump 1, i.e. is channeled repeatedly through the pump housing 6, sufficient heating of the dishwashing liquid is reliably ensured and an efficient heater is provided for heating the dishwashing liquid, and which is disposed outside the dishwashing compartment 2 without restricting the space for other subassemblies of the dishwasher.

Figure 5:
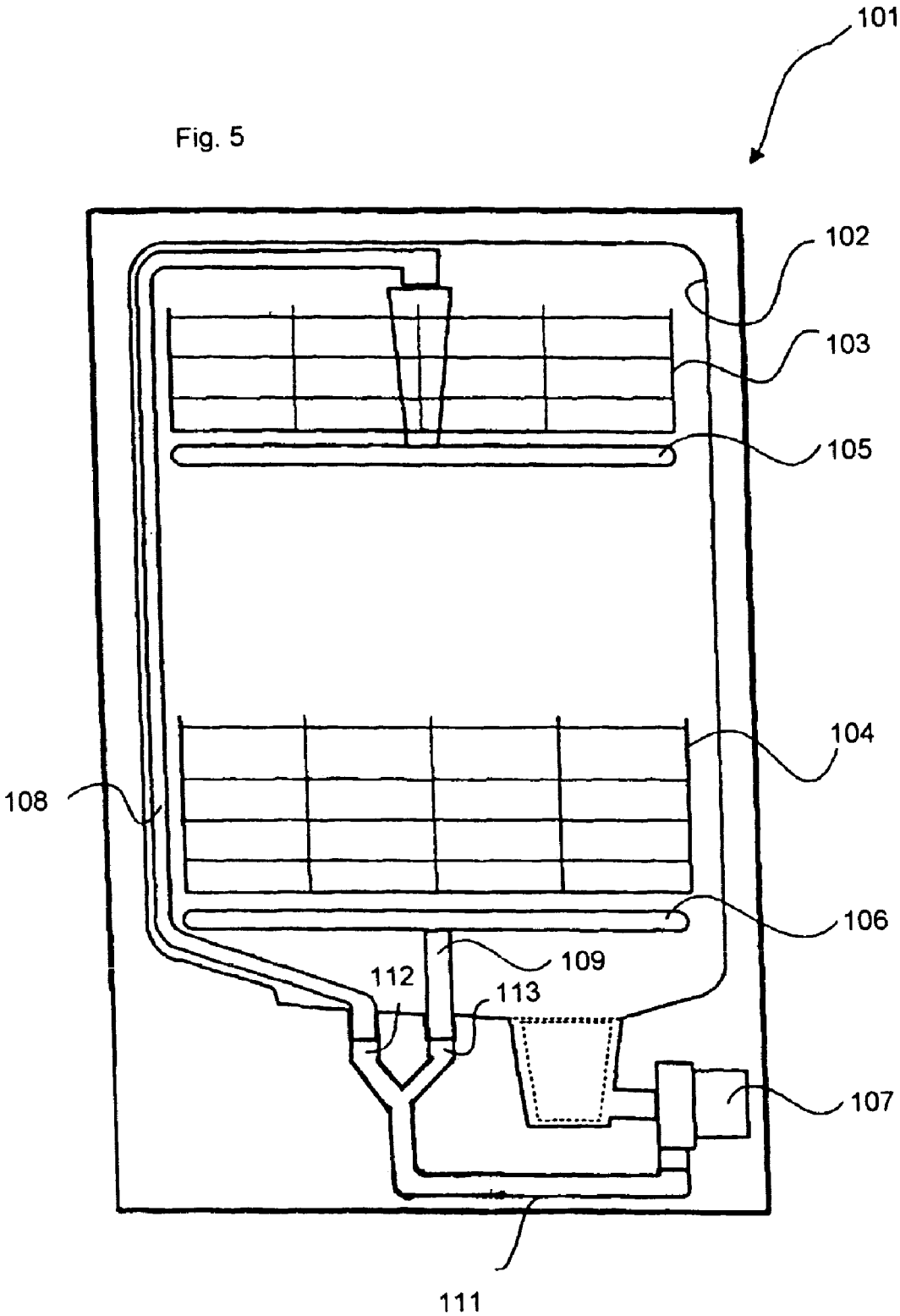
FIG. 5 is a schematic cross-sectional view of a household dishwasher according to the invention.

Referring now to FIG. 5 of the drawings, there is shown a household dishwasher 100 according to the invention having a dishwashing compartment 102 into which items that are to be cleaned, e.g., dirty dishes and cutlery, are introduced, usually into dish racks 103, 104. Two spray devices spray devices 105, 106, are disposed in the dishwashing compartment 102. The spray devices 105, 106 subject the items that are disposed in the dishwashing compartment 102 and that are to be cleaned to the action of liquid. The liquid, usually referred to as dishwashing liquid, is delivered to the spray devices 105, 106 in liquid-supply lines 108, 109 by a circulating pump 107 disposed outside of the dishwashing compartment 102. The liquid delivered in the household dishwasher 100 is directed from the circulating pump 107 through an inflow connection 111 having two outlet connections 112, 113 each respectively communicated with a respective one of the spray devices 105, 106.

We claim:

1. In a dishwasher having a dishwashing compartment and a pump fluidically connected to the dishwashing compartment for channeling liquid to the dishwashing compartment, the pump disposed outside the dishwashing compartment, and including a pump housing compartment, and including a pump housing defining an interior and housing a motor and an impeller, the pump housing defining an inflow conduit through which dishwashing liquid flows out of the dishwashing compartment and into the pump housing into contact with the impeller, a heater for heating dishwashing liquid, the heater comprising:

a heating device disposed at least partially outside the dishwashing compartment on the pump housing, the heating device defining a heat transfer surface extending into heat-conducting contact with the interior of the pump housing and any dishwashing liquid therein, the heating device being operable to provide heat, via its heat transfer surface providing heat-conducting contact with the interior of the pump housing, to the dishwashing liquid flowing through the pump housing such that a substantial portion of the heat that is acquired by the dishwashing liquid is imparted thereto by the heating device.

2. The heater according to claim 1, wherein:

the pump housing has an outside; and said heating device is at least partially disposed on the outside of the pump housing.

3. The heater according to claim 1, wherein the pump housing has an outside with a side facing the motor; and said heating device is at least partially disposed on the outside of the pump housing on the side facing the motor.

4. The heater according to claim 1, wherein:

the pump housing has an outside with a side facing away from the motor;

and said heating device is disposed on the outside of the pump housing on the side facing away from the motor.

5. The heater according to claim 1, wherein said heating device is an electrical resistance heater.

6. The heater according to claim 5, wherein said heating device is a tubular heater.

7. The heater according to claim 5, wherein said heating device is a thick-film heater.

8. The heater according to claim 1, wherein:

the pump housing has a part bearing said heating device; and the part of the pump housing bearing said heating device is made of stainless high-grade steel.

9. The heater according to claim 1, wherein:

the pump housing has a part bearing said heating device; and the part of the pump housing bearing said heating device has an enameled surface.

10. The heater according to claim 1, wherein said heating device has a temperature switch disposed at the pump housing.

11. The heater according to claim 10, wherein said temperature switch is a pressure switch.

12. The heater according to claim 10, wherein said temperature switch is a thermostatic switch.

13. The heater according to claim 12, wherein said thermostatic switch is disposed on the pump housing.

14. The heater according to claim 1, including an insulating layer covering said heating device.

15. The heater according to claim 14, including a protective plate covering said insulating layer.

16. A dishwasher, comprising:

a housing defining a dishwashing compartment;

a pump for channeling liquid to said dishwashing compartment, said pump:

fluidically connected to said dishwashing compartment;

disposed outside said dishwashing compartment and inside said housing; and having a motor, an impeller, and a pump housing defining an interior and housing said motor and said impeller; and a heating device for heating dishwashing liquid, said heating device disposed on said pump housing and defining a heat transfer surface in heat-conducting contact with said interior of said pump housing.

17. A dishwasher, comprising:

a housing defining a dishwashing compartment;

a pump for channeling liquid to said dishwashing compartment, said pump:

fluidically connected to said dishwashing compartment;

disposed outside said dishwashing compartment and inside said housing; and having a motor, an impeller, and a pump housing defining an interior and housing said motor and said impeller, said pump housing defining an inflow conduit through which said dishwashing liquid flows into said pump housing into contact with said impeller and said motor rotating a shaft connected to said impeller so as to rotate said impeller, said pump housing having an outside with a side facing the motor and a side facing away from the motor; said shaft of said motor extends outwardly from said pump housing on the side of said pump housing facing the motor, and said inflow conduit extends outwardly from said pump housing on the side facing away from the motor; and a means for heating dishwashing liquid, said heating means disposed on said pump housing and defining a heat transfer surface in heat-conducting contact with said interior of said pump housing.

18. The heater according to claim 17, wherein said heating device is disposed on the outside of said pump housing on the side facing said motor.

19. The heater according to claim 17, wherein said heating device is disposed on the outside of said pump housing on the side facing away from said motor.

* * * * *